United States Patent [19]

Frauenfeld et al.

[11] Patent Number: 4,651,811

[45] Date of Patent: Mar. 24, 1987

[54] HEAT EXCHANGING BODY

[75] Inventors: Martin Frauenfeld, Heidelberg; Rüdiger von Wedel, Heiligkreuzsteinach-Eiterbach, both of Fed. Rep. of Germany

[73] Assignee: Kraftanlagen AG, Heidelberg, Fed. Rep. of Germany

[21] Appl. No.: 537,369

[22] PCT Filed: Feb. 25, 1983

[86] PCT No.: PCT/EP83/00053

§ 371 Date: Aug. 30, 1983

§ 102(e) Date: Aug. 30, 1983

[87] PCT Pub. No.: WO83/02997

PCT Pub. Date: Sep. 1, 1983

[30] Foreign Application Priority Data

Feb. 27, 1982 [DE] Fed. Rep. of Germany ..... 3307213

[51] Int. Cl.[4] ..... F28D 17/00

[52] U.S. Cl. ..... 165/10; 165/905; 165/7; 55/257 HE; 55/267

[58] Field of Search ..... 165/166, 165, 4, 10, 165/905, 7; 55/257 HE, 267

[56] References Cited

U.S. PATENT DOCUMENTS

| | | | |
|---|---|---|---|
| 2,706,109 | 4/1955 | Ödman | 165/10 |
| 3,176,763 | 4/1965 | Fröhlich | 165/166 |
| 3,931,854 | 1/1976 | Ivakhnenko et al. | 165/166 |
| 4,066,122 | 1/1978 | Gross et al. | 165/DIG. 8 |
| 4,114,597 | 9/1978 | Erb | 165/172 |
| 4,253,491 | 3/1981 | Worthen et al. | 165/47 |
| 4,432,409 | 2/1984 | Steele | 165/10 |

FOREIGN PATENT DOCUMENTS

| | | | |
|---|---|---|---|
| 2414662 | 11/1974 | Fed. Rep. of Germany . | |
| 3137296 | 4/1983 | Fed. Rep. of Germany . | |
| 7131096 | 4/1972 | France . | |
| 7407020 | 11/1974 | Netherlands | 165/166 |
| 1188981 | 4/1970 | United Kingdom . | |
| 1354502 | 5/1974 | United Kingdom | 165/905 |

*Primary Examiner*—Albert W. Davis, Jr.

[57] ABSTRACT

Heat exchanging or accumulator structure for thermal transfer between gas streams in regenerative heat exchangers, especially for the transfer of heat between the boiler exhaust gases cleaned in a scrubber and the foul boiler exhaust gases being fed to the scrubber, composed of molded elements (2; 4*a*; 4*b*; 4*c*) of thermoplastic material selected from the group consisting of polyphenylene oxide, a copolymer of polyphenylene oxide, polystyrene, and polyblends of polyphenylene oxide and polystyrene.

22 Claims, 1 Drawing Figure

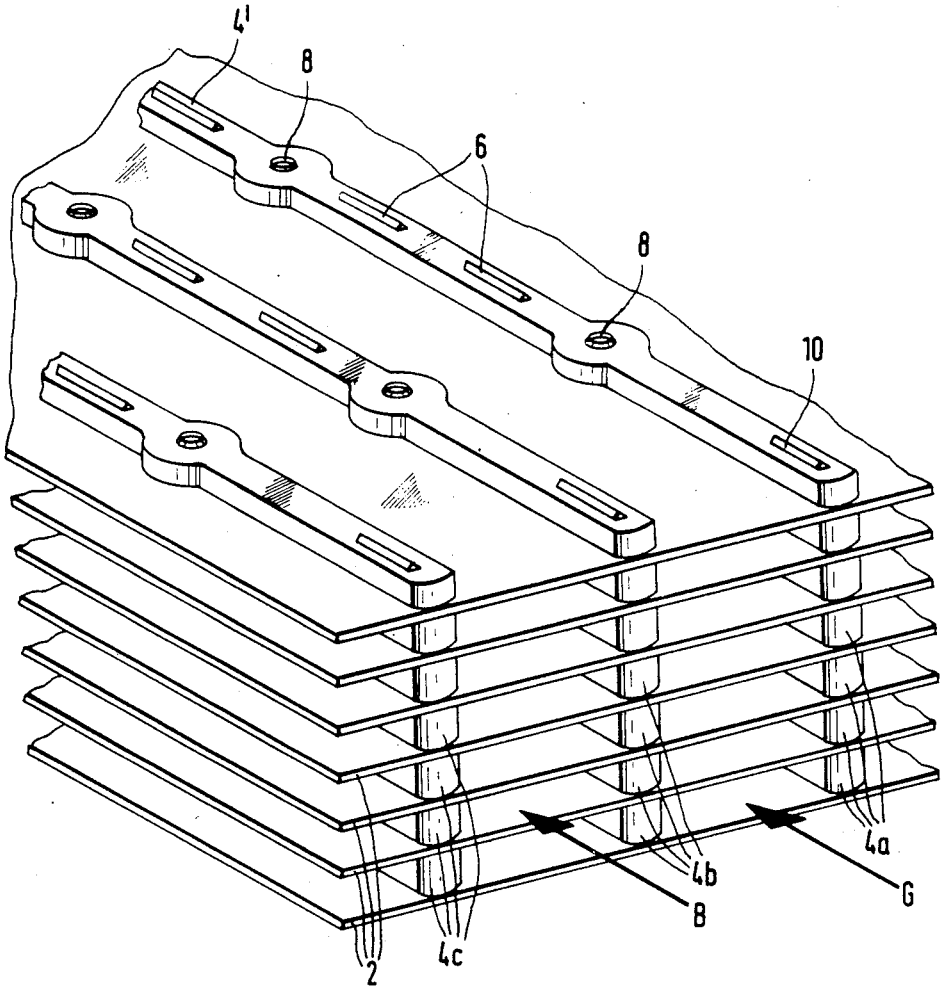
4'
8
6
8
10
4a
4b
B
G
2
4c

HEAT EXCHANGING BODY

BACKGROUND OF THE INVENTION

The invention relates to a heat exchanging or accumulator structure made of plastic for the transfer of heat between gas streams, especially for reheating the boiler exhaust gases cleaned in a scrubber, but the transfer of heat from the foul boiler exhaust exhaust gases being delivered to the scubber.

Metal and ceramic substances are used as materials in regenerative heat exchangers for boiler and air conditioning plants, and for mobile and stationary gas turbines. An old proposal is known for selecting nonmetallic substances of poor thermal conductivity, such as plastics, asbestos, paper or textiles, in the low temperature range, depending on the working temperature in the particular application, for use principally in air-conditioning plants for heat exchange between fresh air and exhaust air (Swiss Pat. No. 334,078). Paper and textiles have not been successfully used, despite the use of selected impregnants and textile dressings, on account of their low wet strength, low stability of shape, high flammability and poor resistance to chemicals such as mineral or organic acids. Furthermore, in connection with the use of these materials in ventilation and airconditioning plants, there are considerable objections to paper and textiles on account of the danger of rotting.

Although plastics have been repeatedly mentioned as exchange materials, no experience has been had in such technical use of plastics. The thermal insulating properties peculiar, as a rule, to plastics, and poor resistance to breakdown under long-term exposure to high temperatures, militate against such use of plastics. Alternating stresses on plastics cause them to lose their stability rapidly with the passage of time.

The heat exchanging material used in the cores of regenerative heat exchangers for reheating previously scrubbed boiler exhaust gases by the transfer of heat from the foul boiler exhaust gases entering the scubber is subjected to special operational stresses. On the side absorbing the heat the material is in contact with raw gases of elevated temperature from which the dust has been removed incompletely or not at all, and on the heat-yielding side it is exposed to gases of low temperature and high moisture content which are carrying along with them residues of chemical sorption and neutralization agents and products from the wet scrubbing. Depending on the chemical composition of the precipitates formed within the accumulator material by the heat exchange under these conditions, the precipitates harden sooner or later to form crusts which adhere more or less tightly to the heat exchanging body and are as a rule insoluble in water, and which completely clog the passages in the core, so that continued operation of the heat exchanger and consequently of the boiler plant is impossible. To clean heavily contaminated and encrusted heating surfaces—usually made of steel or enameled steelW—of heat exchangers connected to the exhaust of boiler plants, soot blowers of special design have been used, whose cleaning jets clean the exchanger core in place, reopen the passages and reliably and completely blast the solid coatings out of the heat exchanging material of the heat exchanger. The powerful jets emerging from the nozzles of the soot blowers cause a fluttering of the plate-like components of the heat exchanging body. On the other hand, it is precisely such fluttering of the heat exchanging body that is in plate form that is especially capable of breaking off crusts and coatings that are tightly adhering to it.

Regenerative heat exchangers having metal cores, however, can be used under the special operating conditions described above only for limited periods of time and only with very greatly increased cleaning cost and difficulty.

The invention is therefore addressed to the problem of developing a heat exchanging body which can be manufactured simply an economically, whose surface has a low affinity for the components of raw gases before and after scrubbing, and which has a high long-term stability even under alternating stress by cleaning jets.

SUMMARY OF THE INVENTION

In accordance with the invention, this problem is solved by composing the heat exchanging body of molded elements and making these elements to consist of or contain thermoplastics from the polyphenylene oxide group. Moldings of any desired shape can be made from polyphenylene oxides, namely slat-like moldings to be used as spacers, and plate-like moldings to produce the heat exchange. This can be accomplished by a variety of methods, e.g., by injection molding in the one case and by extrusion in the other, if the appropriate molding temperatures are provided, which are around 200 degrees C., for example. In this manner, a high surface quality and surprising surface effects are obtained, which tend to prevent any tight bonding of scale to the surface of the heat exchanging elements.

In order to improve the properties of the thermoplastic for ease in manufacturing the molded elements while making provision for the anticipated operating temperatures of the heat exchanger, copolymers of polyphenylene oxides with polystyrene or polyblends of polyphenylene oxide with polystyrene can be used to advantage. In this case the physical properties of the heat exchanging material after manufacture as well as its working properties are adaptable to given conditions by varying the proportions of the polyphenylene oxide and polystyrene.

Polyphenylene oxides have commonly known disadvantageous properties for the application herein concerned, such as liability to tension cracking, embrittlement, and rapid aging. Mixtures of polyphenylene oxide and polystrene used as the base material satisfy the requirements for the simple manufacture of moldings having sufficient thermal stability for this industrial use.

The heat exchanging body in accordance with the invention is so constructed that slat-like moldings serving as spacers join together a plurality of plate-like moldings serving as heat exchanger plates to form heat exchanger blocks.

On the other hand, the possibility also exists of making the spacers integral with the plate-like heat exchanging elements.

For ease in manufacture, injection molding is chosen as the process for manufacturing the slat-like spacer, and extrusion for making the plate-like heat exchanging elements.

It is furthermore advantageous for the production of the heat exchanging body if the slat-like spacer moldings have, on their faces at which they are to be joined to the plate-like core elements, axially discontinuous segments of triangular cross section. In the manufacture of the heat exchanger blocks, the plate-like elements and the slat-like moldings used as spacers between them are best joined by ultrasonic welding.

The mass of heat exchanging material in regenerative heat exchangers is, as a rule, contained in sector-like chambers in a supporting structure. In order to build heat exchanger blocks to fill these chambers, the plate-like elements and the slat-like moldings serving as spacers are alternated with one another and joined together step by step by ultrasonic welding to form a heat exchange block.

To achieve a tight bond and permit effective ultrasonic welding, however, and to maintain the bond while the unit is in actual operation, the plate-like elements are joined to the slat-like moldings by linear but discontinuous welding seams running lengthwise of the slat-like moldings.

Particularly advantageous in this case is a further development in which the spacers and the plate-like elements are joined to one another by one or more linear ultrasonic welds alternating with ultrasonic spot welds.

On the one end of the exchange block, the spot welds are preferably at a greater distance from this end than at the other end, at which such welds between the plate-like heat exchanging elements and the slat-like spacer moldings terminate in each case in a spot weld. In this manner the plate-like heat exchanging elements are held in a quasi-articualted manner in the areas between the spacer moldings, i.e. they are not connected to each other rigidly but they permit a limited relative tilting. This permits the fluttering movements which are advantageous for the removal of incrustations.

To avoid any loss of alignment of the heat exchange block during production on account of the step-by-step manner in which the welds are made, provision is made for a tack weld in the form of a linear welding seam of short length at the end of the core at which the spot welds are at the greater distance from the end, at a point between the spot weld and the end, preferably immediately at the latter, this tack weld forming points at which the slats can be broken free from the plate-like elements which can then vibrate when the heat exchanger is in operation. The length of this linear tack weld is best made shorter than the length of the linear welding seams that follow it in the axial direction on the spacer.

For the production of sector-shaped heat exchange blocks to fit in the sector-shaped chambers of the supporting structure of regenerative heat exchangers, one heat exchange block, or a plurality of heat exchange blocks in tandem, are cut to fit into the sector-shaped chambers of the exchanger core supporting structure.

To make the entrance-end portions of the plate-like heat exchanging elements of the individual core blocks particularly capable of vibation, a thickness of 1 to 3 mm, preferably of 1.5 mm, is selected for the plate-like heat exchanging element, while the heat exchange block has a height of 100 mm or more.

Furthermore, it is recommendable to arrange the slat-like spacer moldings at 20 to 90 mm, preferably 50 mm, apart, their thickness over the crests of the prismatic segments being 3 to 6 mm, preferably 4 mm, and their width 4 to 6 mm, preferably 5 mm.

The spaces between successive linear welds are preferably between 8 and 15 mm, preferably 12 mm long, the spot welds succeeding one another over the plate height at a distance of 50 to 70 mm, preferably 60 mm, apart. With regard to the spot welds it is advantageous for the slat-like moldings to have in the area of each spot weld a circular broadening with circular rings of triangular cross section on both sides.

These button-like joining areas are preferably expanded to a diameter between 8 and 15 mm, preferably 10 mm, in which case the circular rings have a diameter between 6 and 13 mm, preferably 7.5 mm.

In addition to the known stability of the basic material in the high-temperature range, an only slightly reduced longterm stability of the heat exchange block under practical conditions of use is surprisingly achieved, particularly also with regard to the alternating stresses to which the platelike elements contained in the core are subjected by the cleaning jets. Important to this performance are the articular connections between the plate-like heat exchanging elements and the slat-like spacer moldings.

DESCRIPTION OF PREFERRED EMBODIMENTS

A plate pack formed in the manufacture of an exchanger core block is represented in perspective in the drawing for the purpose of explaining the invention.

The drawing shows a fragmentary view of a pack of plates 2 with interposed slat-like spacer moldings 4*a*, 4*b* and 4*c*, during the manufacture of the heat exchange block.

In the drawing, seven of the plate-like elements 2 have already been joined together alternately with slat-like spacer moldings 4*a*, 4*b* and 4*c* by means of ultrasonic welding. On the top plate 2 of the pack, the next series of spacer moldings 4' has been laid. For welding to the next-following plate (not shown), the spacer moldings 4' are provided on both sides, i.e., also on the invisible underside, with the segments 6 of triangular cross section extending in the axial direction for linear welds on the one hand, and circular projections 8 for spot welds on the other hand. Prior to the ultrasonic welding, first the next plate is laid on the uppermost set of spacer moldings. The ultrasonic welding thus takes place progressively by a remote weld to join the bottom of the moldings 4' to the plate 2 underneath it, simultaneously with a proximate weld to joint its upper side to the plate which is to be laid thereon.

The spacer moldings or segments are provided in the area of the spot welds, like the segments 8 of circular plan and triangular cross section, with rounded projections, so that in these areas very strong, button-like junctions are formed. In the section of the plate pack shown in the drawing, the rectilinear edges of the plate-like heat exchanging elements are situated at what is later to be the area of entry of the dust-laden gases, whose direction of flow is indicated by the arrow G. The cleaning jets of the soot blower act in the same direction, this being indicated by the arrow B.

The slat-like spacer moldings 4*a*, 4*b* and 4*c* are provided with widenings which bear the projections of circular plan for the ultrasonic spot welds and which are set back from this area of entry.

Directly adjacent the area of entry, prismatic segments 10 are provided which are shorter than the other axially disposed prismatic segments 6 for making the linear welds. These projections serve only as an aid in assembly. They fix the plate pack or heat exchanger block in the area of the end in question, where they prevent any misalignment due to the step-by-step ultrasonic welding during the assembly of the heat exchanger block from the heat exchanging plates and spacers.

What is claimed is:

1. A regenerative heat exchanging structure for heat transfer between gas streams, especially for reheating boiler exhaust gases cleaned in a wet cleaning stage by heat transfer from uncleaned boiler exhaust gases to be delivered to a wet cleaning stage, comprising: a plurality of spaced, plate-like accumulator elements, and a plurality of slat-like spacer elements spacing said accumulator elements apart from each other and connected to said accumulator elements, said elements consisting of plastics material selected from the group consisting of polyphenylene oxide, a copolymer of polyphenylene oxide and polystyrene, and polyblends of polyphenylene oxide and polystyrene.

2. A structure according to claim 1, wherein said slat-like elements each have a plurality of protruding spaced segments of triangular cross section extending in longitudinal direction of the resepective slat-like spacer elements, for connecting adjacent accumulator and spacer elements to each other.

3. A structure according to claim 2, wherein said each slat-like elements have a plurality of projection between adjacent segments for connecting adjacent accumulator and spacer elements to each other.

4. A structure according to claim 3, wherein button-like projections connect said accumulator and spacer elements.

5. A structure according to claim 4 having two ends, said button-like projections between adjacent accumulator and spacer elements being arranged closer to one end than the other.

6. A structure according to claim 5, comprising a segment of shorter length than said segments between said other end and the adjacent button-like projection.

7. A structure according to claim 1, wherein said accumulator elements have a thickness of 1 to 3 mm, and said structure is at least 100 mm high.

8. A structure according to claim 7, wherein said thickness is 1.5 mm.

9. A structure according to claim 7, wherein said slat-like elements are spaced from each other a distance of from 20 to 90 mm.

10. A structure according to claim 9, wherein said spacing is 50 mm.

11. A structure according to claim 7, wherein the thickness of said spacer elements is 3 to 6 mm and their width is 4 to 6 mm.

12. A structure according to claim 11, wherein said thickness is 4 mm and said width is 5 mm.

13. A structure according to claim 2, wherein the spacing between adjacent segments is from 8 to 15 mm.

14. A structure according to claim 13, wherein said spacing is 12 mm.

15. A structure according to claim 3, wherein said projections on each spacer element are spaced from each other by 50 to 70 mm.

16. A structure according to claim 15, wherein said spacing is 60 mm.

17. A structure according to claim 3, wherein said projections are button-like with an annular broadening of triangular cross section.

18. A structure according to claim 17, wherein said buttonlike projections broaden to a diameter between 8 and 15 mm.

19. A structure according to claim 18, wherein said diameter is 10 mm.

20. A structure according to claim 17, wherein said annular broadening has a diameter between 6 and 13 mm.

21. A structure according to claim 20, wherein said diameter is 7.5 mm.

22. A structure according to claim 1, wherein said plate-like accumulator elements are extruded accumulator elements, and wherein said slat-like spacer elements are injection-molded spacer elements.

* * * * *